US006423952B1

(12) United States Patent
Meisiek

(10) Patent No.: US 6,423,952 B1
(45) Date of Patent: Jul. 23, 2002

(54) HEATER ARRANGEMENT WITH CONNECTOR OR TERMINATING ELEMENT AND FLUOROPOLYMER SEAL, AND METHOD OF MAKING THE SAME

(75) Inventor: Juergen Meisiek, Muensterdorf (DE)

(73) Assignee: Airbus Deutschland GmbH, Hamburg (DE)

( * ) Notice: Subject to any disclaimer, the term of this patent is extended or adjusted under 35 U.S.C. 154(b) by 0 days.

(21) Appl. No.: 09/685,792

(22) Filed: Oct. 10, 2000

(30) Foreign Application Priority Data

Oct. 9, 1999 (DE) ..... 199 48 819

(51) Int. Cl.[7] ..... H05B 3/06
(52) U.S. Cl. ..... 219/544; 219/541; 439/271
(58) Field of Search ..... 219/544, 541, 219/535, 528; 439/281, 587–589, 271, 278

(56) References Cited

U.S. PATENT DOCUMENTS

| | | | | |
|---|---|---|---|---|
| 3,341,690 A | | 9/1967 | Commins | |
| 4,066,870 A | | 1/1978 | Colten | |
| 4,101,190 A | | 7/1978 | Schoff | |
| 4,419,569 A | * | 12/1983 | Colten | 219/528 |
| 4,639,066 A | | 1/1987 | Shimamiya et al. | |
| 5,067,912 A | * | 11/1991 | Bickford et al. | 439/578 |
| 5,155,800 A | * | 10/1992 | Rezabek et al. | 219/544 |
| 5,510,405 A | * | 4/1996 | Heucher et al. | 439/271 |
| 5,998,772 A | | 12/1999 | Kirma et al. | |
| 6,126,483 A | | 10/2000 | Kirma et al. | |

FOREIGN PATENT DOCUMENTS

| | | | |
|---|---|---|---|
| DE | 1056221 | | 12/1961 |
| DE | 1893605 | | 5/1964 |
| DE | G8504019.3 | | 5/1985 |
| DE | G8503674.9 | | 6/1985 |
| DE | 4328207 | * | 2/1995 |
| DE | 4338699 | | 2/1995 |
| DE | 19726418 | | 1/1999 |
| DE | 19726419 | | 1/1999 |
| EP | 0187636 | | 7/1986 |

OTHER PUBLICATIONS

Excerpt of Product Catalog: "Products for Freeze Protection", Wittmann GmbH, Heidelberg, Germany.
Excerpt of Product Catalog: "Heizelemente und Widerstände", p. 17, friedr.freek GmbH.
Excerpt of Product Catalog: "bringt Wärme auf den Punkt bis 1000° C.—optimal dosiert—für Industrie und Labor", Wittmann GmbH, Heidelberg, Germany.
Excerpt of Product Catalog: "The BARTEC Group".

* cited by examiner

*Primary Examiner*—Joseph Pelham
(74) *Attorney, Agent, or Firm*—W. F. Fasse; W. G. Fasse

(57) ABSTRACT

A heater arrangement such as a heating band is especially suitable for providing freeze protection for water pipes in an aircraft, because it is resistant to vibrations, greatly varying temperatures, low pressure conditions, and aggressive chemicals, while achieving a reliable seal against the penetration of moisture or liquid into the areas of the electrical connections. The heater arrangement includes a heating element with a heater band matrix and heating conductors extending therein, as well as a fluoropolymer protective layer thereover. A connecting element or a terminating element is connected to exposed ends of the heating conductors. To seal the area at which the connecting element or terminating element is connected to the heater arrangement, a fluoropolymer is extruded over this area, and/or a fluoropolymer molded part is used as a connection block or end cap. The fluoropolymer materials are thermally fused together to form a continuous integral seal.

42 Claims, 5 Drawing Sheets

HEATER ARRANGEMENT WITH CONNECTOR OR TERMINATING ELEMENT AND FLUOROPOLYMER SEAL, AND METHOD OF MAKING THE SAME

PRIORITY ClAIM

This application is based on and claims the priority under 35 U.S.C. §119 of German Patent Application 199 48 819.3, filed on Oct. 9, 1999, the entire disclosure of which is incorporated herein by reference.

FIELD OF THE INVENTION

The invention relates to a heater arrangement such as a heater cable including a connector and/or a terminating element at an end thereof, and using a fluoropolymer material to provide a seal. The invention further relates to a method of manufacturing such a heater arrangement.

BACKGROUND INFORMATION

Heater arrangements of the above mentioned general type are used for heating pipe systems such as water lines, water tanks, valves and armatures as well as structural components in which liquid products are to be transported, in order to achieve an active frost protection to prevent freezing of the liquid being transported therein when the surrounding ambient environment drops to temperatures below the freezing temperature. Especially in aircraft, which are subjected to extremely low outside temperatures during long flights, it is possible that the various water lines including fresh water lines and waste water lines will freeze if an adequate frost protection is not provided. This could lead to the failure of the entire fresh water or waste water system of the aircraft and, for example, make it impossible for the passengers to use the toilets or the like. For this reason, it has become commonly known to use such heater arrangements, especially in the form of heating bands or heating cables, on the water systems of aircraft.

The heating bands that are used for such heater arrangements conventionally comprise a heating element as well as connecting conductors or conductor strands. The heating element itself is insulated and protected by an insulating layer of a fluoropolymer synthetic plastic. Onto this inner jacket of fluoropolymer, a protective shielding conductor braid is arranged, and then a plastic outer protective jacket or sheath encloses this heater arrangement. The heating bands are typically commercially available as "yard goods". In other words, the heating band is available in the form of a long continuous coil, and an appropriate length of the heating band is simply cut from the coil and must then be assembled or fabricated with other components to meet the need of the particular application, as follows.

A connecting member must be provided on at least one end of the heating band in order to enable the interconnection of several heater arrangements or the connection of a respective heater arrangement to a source of electrical power. In order to achieve this, an end of the heating band is "stripped" to remove the protective jackets or sheaths on the inside and the outside, so as to expose the connection conductors. The heating element portion itself is shortened so that the connection conductors are sufficiently exposed to reach an adequate length so as to then be used as an interconnection line. The individual strands of the protective conductor braid must be combed out and then twisted together, and then connected to an additional extension line. The respective lengths of the connection conductors and of the extension line of the protective braid are matched or adapted to each other so that they respectively end flush with one another.

The transition region between the heating band and the connection lines or conductors must be sealed in a pressure-tight manner that is also resistant to chemical influences and substantial temperature variations, which requires a rather complicated and time consuming process. This is necessary if the heater arrangement is to be used in an aircraft, because for such applications, the influences of vibrations, greatly varying temperatures, low pressure conditions, and the influence of various aggressive chemical agents must necessarily be taken into account so that it can be ensured that the heater arrangement does not fail due to such influences.

In the above context, to achieve such a sealing of the transition region at the connection end of a heater band, the prior art calls for a process in which at least respectively one adhesive and/or potting mass is manually applied to each connection area and then covered with a shrinkable tubing such as a heat shrink tube. Moreover, a complex adhesive pretreatment is necessary, whereby the following steps must be carried out in order to achieve a sufficient bonding between the epoxy adhesive and the fluoropolymer plastic surface (e.g. fluorinated ethylene propylene-FEP) of the heater band: the outer and inner jackets or sheaths must be abraded or otherwise roughened; the region to be adhesively bonded must be cleaned with a solvent or cold cleaning agent, for example ethanol; an etching compound, for example TETRA-ETCH, must be applied to the area and allowed to take effect; then the etchant must be washed away using de-ionized water and subsequent cleaning with a solvent or cold cleaning agent; then the heating band must be dried in a circulating air oven; and finally after the above pretreatment, the epoxy adhesive must be applied and the adhesive bonding of the shrinkable tube must be carried out within a limited period of time.

Since several shrinkable tubes are adhesively bonded in several layers, the time and complexity involved in the above fabrication process for fabricating this connection area is multiplied accordingly. Moreover, when the finished connection area is subjected to mechanical loads, for example during installation or due to operational vibrations, it has been found that the adhesively bonded joints can become separated, especially because the cured epoxy adhesive is relatively rigid while the fluoropolymer plastic such as FEP remains relatively flexible, so that the two materials are not very compatible with each other in relation to mechanical flexure.

A further difficulty or disadvantage with the conventional process for fabricating the connection areas as described above is that a specialized workplace with its own air exhaust or air processing system is necessary for carrying out at least the etching step of the process. Namely, the use of such etching compounds raises environmental concerns as well as health and safety concerns for the workers carrying out the above process. Finally, the disposal or reprocessing of the etching compounds involves additional costs and difficulties.

The above processes are also necessary for fabricating a terminating member on a terminal end of such a heater arrangement. Namely, for such a terminating member it is similarly necessary to carry out an etching process to prepare the components for a subsequent adhesive bonding using an epoxy adhesive on the FEP material of the protective jacket or sheath.

U.S. Pat. 5,998,772 (Kirma et al.) and U.S. Pat. 6,126,483 (Kirma et al.), which are both commonly owned with the present application, disclose heating conductor arrangements that can be coupled to one another or connected to an appropriate electrical power supply by means of special connection modules. Generally, these patents call for a connection technology in which the transition or joint area is provided with a split housing, whereby the interior space of the housing is completely filled with an adhesive and potting compound after completion of the necessary connections, in order to provide a reliable protection against the penetration of moisture or liquid. In the event that fluoropolymer (e.g. FEP) sheaths or jackets are used, in order to achieve a good adhesion of the potting compound with the FEP surfaces, the disclosed systems and processes would also require an adhesive pretreatment, for example using an etching technique. Thus, the above mentioned disadvantages such as a time intensive and complicated pretreatment process, health and safety risks while using various etching compounds such as TETRA-ETCH, as well as the necessary disposal or reprocessing of the etching compounds, will also be expected to apply in the context of these patented technologies.

The present invention is related to and provides a further improvement over the technologies disclosed in the above mentioned U.S. Pat. Nos. 5,998,772 and 6,126,483. The entire disclosure of each of these prior U.S. Patents is incorporated herein by reference to provide background information.

The general problem in the conventional techniques discussed above is that the fluoropolymer surfaces of the jackets or sheaths of the heating conductors and the like, which are made of fluorinated ethylene propylene (FEP) for example, are not compatible with and do not readily establish a good bond with respect to epoxy adhesives or other typical adhesive and potting materials. The prior art has not yet found a solution to this problem, and so it has not been possible to achieve an adequate seal in an acceptably simple manner when using FEP or the like as the material of the jackets of the components of the heater arrangement.

SUMMARY OF THE INVENTION

In view of the above, it is an object of the invention to provide a heater arrangement of the general type described above, which has at least one connecting element and/or at least one terminating element, which is especially suited for use as a heater for aircraft water systems, and achieves an adequate seal to prevent the penetration of moisture and liquids into the connection region of the heater arrangement, while resisting the influence of vibrations, substantial temperature variations, low pressure conditions, and various aggressive chemicals. It is another object of the invention to provide a method of assembling or fabricating such a heater arrangement that is simpler, less time consuming, more economical, and safer than the prior art methods. It is a further particular object of the invention to retain the benefits of using a fluoropolymer material for the sheath or jacket of heater arrangement components, while nonetheless easily achieving a reliable seal relative to the fluoropolymer material. The invention further aims to avoid or overcome the disadvantages of the prior art, and to achieve additional advantages, as apparent from the present specification.

SUMMARY OF THE INVENTION

The above objects have been achieved according to the invention in a heater arrangement comprising a heating element and a connecting element and/or a terminating element connected to the heating element. Throughout this specification, the connecting element will also be referred to as a "connector", and the terminating element will also be referred to as a "terminator". The heating element in turn comprises a heating band and heating conductors, and is further enclosed or ensheathed by a fluoropolymer protective layer. Furthermore, especially according to the invention, an additional fluoropolymer synthetic material is provided in the area of the connector and/or the terminator in order to achieve a seal in this area. For example, the heater arrangement may further comprise a molded plastic part, preferably made of FEP, arranged in the area of the connector or the terminator to provide a transition and contribute to the seal between the end of the heating band and the connector or the terminator. A further fluoropolymer layer may be thermally welded, melted, fused or extruded to the molded plastic part in a transition area. In the case of the heater arrangement including a terminating element or terminator, the molded plastic part may be in the form of an end cap that closes and insulates the terminal end of the heating band.

The above objects have further been achieved according to the invention in a method of fabricating a connector element or a connector on an end of a heater arrangement, including the following steps. A heating band with at least one heating band conductor is cut open so as to expose the at least one heating band conductor in a prescribed area based on prescribed length dimensions needed for a particular application, in order to fabricate at least one connector at the cut location. By means of an extrusion process, a fluoropolymer synthetic plastic layer, preferably consisting of fluorinated ethylene propylene (FEP), is applied onto the heating band. A shielding braid is arranged on the fluoropolymer synthetic plastic layer. The shielding braid is cut back in the area of at least one connector, whereby respectively a connection or junction lead is formed at the cut location of the respective shielding braid. One end of a respective extension line is connected to the respective junction lead. At least one further extrusion process is carried out to apply an outer protective jacket or sheath of a fluoropolymer synthetic plastic, preferably FEP, onto the heater arrangement and at least over partial areas of the connecting elements. The areas of the connecting elements are then completed by connecting power lines or the like to the heating band conductors, and/or by providing contact elements on the heating band conductors and/or the extension line and/or the power lines.

A variant of the method according to the invention relates to fabricating a terminating element or terminator on a terminal end of a heater arrangement, comprising the following steps. A heating band having at least one heating conductor is cut open so as to expose the at least one heating conductor at a prescribed area based on a prescribed length dimension, for receiving at least one terminating element at the cut area. By means of an extrusion process, a fluoropolymer synthetic plastic layer, preferably consisting of FEP, is applied onto the heating band. A protective braid is arranged on the fluoropolymer synthetic plastic layer and then cut back in the area of the terminating element. The strands of the heating conductors are freed or exposed in the end region of the terminating element. By means of a further extrusion process, an outer protective jacket or sheath of a fluoropolymer plastic, preferably FEP, is applied onto the heater arrangement and at least partially or on partial areas on the terminating element areas of the heater arrangement. Then, to achieve a final seal, i.e. to achieve a sufficient sealing, the FEP material in the end portion of the terminating element or elements is thermally welded or extruded.

It is especially advantageous that the invention avoids surface treatments of the FEP layer, which were necessary according to the prior art, and which are potentially dangerous or injurious to the health of the workers carrying out such treatments, and also avoids the use of environmentally undesirable agents such as etching agents. Also, the inventive arrangement omits any further plastic materials in addition to the fluoropolymer synthetic plastic material FEP, which exhibits the best possible characteristics of resistance to the SKYDROL hydraulic oil typically used in aircraft hydraulic systems, moisture resistance and protection, good insulating protection, as well as a good flexibility. Thus, the invention maintains the advantageous use of FEP as a jacketing or sheathing material, while avoiding the previously associated with the difficulty of forming a seal relative to the FEP material. Also according to the invention, additional components, such as shrinkable tubes or the like are no longer necessary, and thereby the time consuming and complex processes for fabricating the connecting element and/or the terminating element on an end of the heater arrangement have been avoided or significantly simplified.

BRIEF DESCRIPTION OF THE DRAWINGS

In order that the invention may be clearly understood, it will now be described in connection with example embodiments, with reference to the accompanying drawings, wherein:

FIGS. 1A, 1B, 1C, 1D, 1E and 1F show successive steps in the process of fabricating the connecting element on the heater arrangement;

FIGS. 2A, 2B and 2C show successive steps in the process of fabricating the terminating element on the heater arrangement;

FIGS. 3A, 3B, 3C, 3D, 3E, 3F, 3G, 3H and 3I show successive steps in the process of fabricating the connecting element on the heater arrangement.

DETAILED DESCRIPTION OF PREFERRED EXAMPLE EMBODIMENTS AND OF THE BEST MODE OF THE INVENTION

Figure 1A:
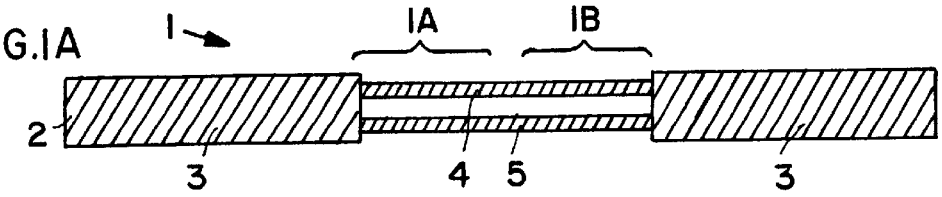
FIGS. 1A to 1F are schematic sectional or broken-away views illustrating the construction of a heater arrangement with a connecting element provided at an end thereof, whereby

As shown in FIG. 1A, the basic or principle element of a heater arrangement 1 is the heating element 2. In the illustrated embodiment, the heating element 2 is in the form of a heating band that comprises a heating band matrix 3 made of a mixture of a plastic, especially a fluoropolymer plastic such as FEP mixed with carbon, and this heating band matrix 3 has heating band conductors 4 and 5, preferably in the form of copper or nickel conductor strands, extending therethrough. The mixture of carbon and plastic forming the heating band matrix 3 is properly selected to provide the required resistance and thereby generate the required degree of heating when electrical power is provided to the conductors 4 and 5. In the area of the heating conductor connecting elements 1A and 1B, i.e. the area that is to be fabricated as connecting elements, the heating band conductors 4 and 5 are exposed, for example by removing the heating band matrix material 3, so that the exposed conductors 4 and 5 can be used as connecting lines for connecting to the power supply of the power network of the aircraft or the like in which the heater arrangement 1 is to be installed. Already while being fabricated, the respective heater arrangement 1 is produced in the appropriate length. In this context, the length of the heater arrangement is determined by the requirements of the particular installation or application, e.g. the length of the water lines that are to be heated by arranging the heater arrangement 1 therealong.

Typically, the raw starting material of the heating element 2 is available as "yard goods", for example in the form of a long coil of the heating band 3 with the conductors 4 and 5 extending continuously therein. According to the inventive method, the first step does not involve completely cutting through or separating the heating element 2 at the location of the intended connecting elements, but instead simply the internal conductors 4 and 5 thereof are exposed by removing the heating band matrix 3. A complete separation of the heater arrangement 1 at this area will only be carried out in a later fabrication step. In this manner, not only one connecting area or connecting element 1A, but simultaneously a second connecting area or element 1B are fabricated at the same time.

Figure 1B:
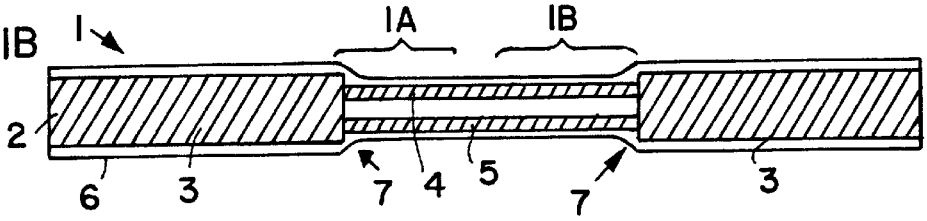

FIG. 1B shows the next successive step in the fabrication process. Namely, after the heating band conductors 4 and 5 have been exposed, an extrusion process is carried out so as to apply a layer 6 of a fluoropolymer plastic (e.g. fluorinated ethylene propylene-FEP) onto the heating element 2, including the heating band 3 and the conductors 4 and 5. This extrusion process thus forms an insulating and protective layer 6 of this plastic mass, which is embodied in a watertight and pressure-tight manner, especially in the transition region 7 of the layer 6 transitioning from the heating band 3 to the exposed conductors 4 and 5. In this manner, an improved sealing is ensured at the location of the heater arrangement connections 1A and 1B. All of the extrusion processes identified herein are carried out under vacuum in order to avoid air inclusions in the extruded layers.

Figure 1C:
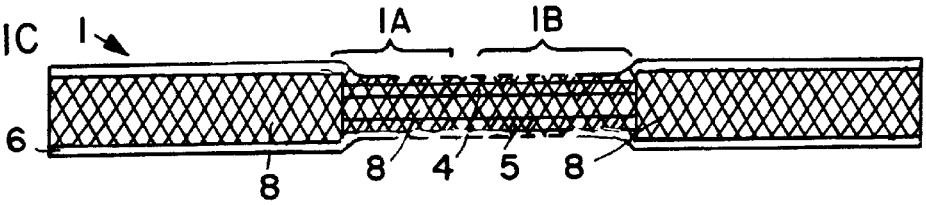
Figure 1D:
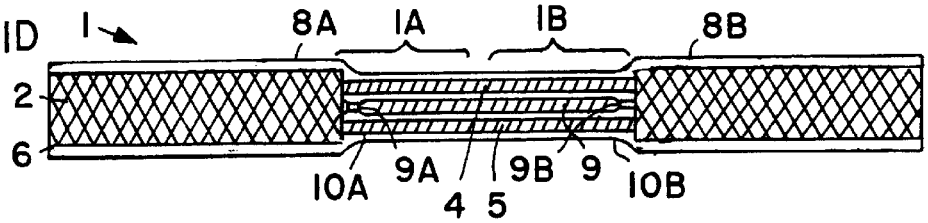
Figure 1E:
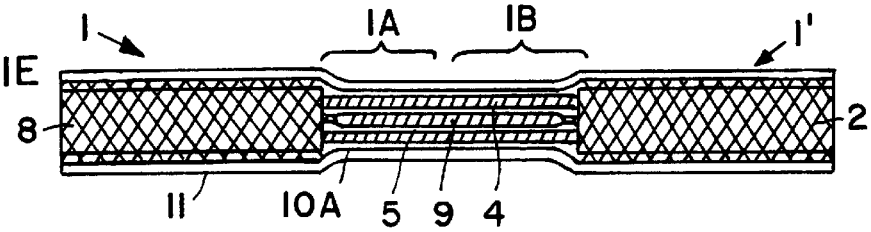

FIG. 1C shows a further method step for fabricating the heater arrangement 1 with a heater arrangement connection 1A or 1B. After the insulating layer 6 is applied onto the heating element 2 as described above, next a shielding braid 8 is applied thereon. Preferably, the shielding braid 8 is a spiral woven or braided tube of copper/nickel. This shielding braid 8 must then be cut back in the area of the heater arrangement connection 1A and 1B, as shown in FIG. 1D. Then, an additional extension line 9 is connected to the shielding braid 8, whereby this extension line 9 is provided with an FEP jacket or sheathing. This can be achieved in a typical manner by combing out and twisting the braid, i.e. the braided strands of the shielding braid 8, and then connecting these twisted strands to the extension line 9. Alternatively, as shown in FIG. 1D, this can be achieved by welding, soldering or splicing the conductor connections 9A or 9B of the extension line 9 with the corresponding side of the shielding braid 8A or 8B. Before the welding, soldering or splicing step, the extension line 9 is fixed in a point-wise manner using an adhesive to hold it in the illustrated arrangement. Moreover, the heating band conductors and particularly the connection conductors 4 and 5 thereof, as well as the extension line 9, are held and fixed in place using a TEFLON (polytetraf luoroethylene (PTFE) or fluorinated ethylene propylene (FEP)) band or tape 10A, 10B.

FIG. 1 E shows the heater arrangement 1 after the above mentioned process steps of FIGS. 1A to 1D have been completed. Next, the heater arrangement 1 is provided with a protective sheath or jacket 11 which similarly consists of a fluoropolymer plastic, preferably FEP, which is applied onto the heater arrangement 1 and the connection areas or connection elements 1A or 1B by means of an extrusion process, whereby the heating band connection conductors 4 and 5 as well as the extension line 9 are completely enclosed and jacketed by the protective sheath 11. After this extrusion process, the heating element 2 is completely cut through and separated on a cutting plane in the area of the heating band connection conductors 4 and 5 as well as the extension line 9. Thereby, two separate heater arrangements 1 and 1, each having a respective prepared end that is ready to form a respective connecting element 1A or 1B, have been provided. Next, the respective connecting element 1A or 1B will be completed.

Figure 1F:
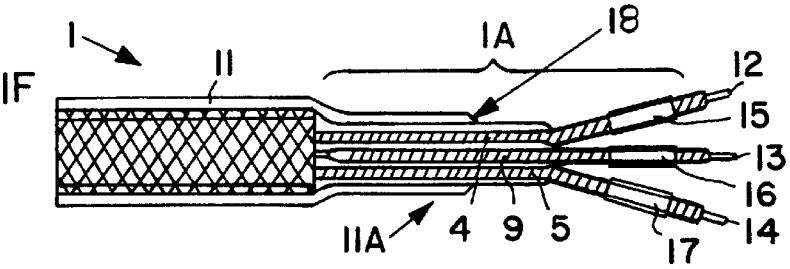

FIG. 1F shows the finished heater arrangement 1 with the heater arrangement connecting element 1A at an end thereof. The complete outer FEP protective sheath 11 and the FEP layer 6 have been removed from the ends of the respective conductors 4, 5 and 9, to free these respective conductors 4, 5 and 9 while each one of these separate conductors 4, 5 and 9 remains provided with its own individual protective layer of FEP. This step may be achieved by rather simple means using a stamp-cutting process to separate the three conductors 4, 5 or 9 from each other. Then, each separate conductor 4, 5 or 9 is respectively equipped with a single pin contact 12, 13 or 14 at its respective end. Preferably, these contacts are crimped onto the respective ends of the conductors. Furthermore, the separate or free ends of the three conductors 4, 5 and 9 are provided with respective colored shrinkable tubes 15, 16 and 17, for example respectively red, white and blue tubes 15, 16 and 17, in order to distinguish and identify the three conductors.

The exit region 18 at which the heating band connection conductors 4 and 5, as well as the extension line 9 exit out of the FEP protective sheath 11 is thereafter further extruded or thermally welded to form a thermally welded region 11A, which ensures a sufficiently tight seal relative to the shielding braid 8. It is further possible to arrange various identifying indicia on the protective sheath 11 or the thermally welded region 11A thereof, in order to facilitate the identification of the respective heater arrangement 1 in its further use or application.

Figure 2A:
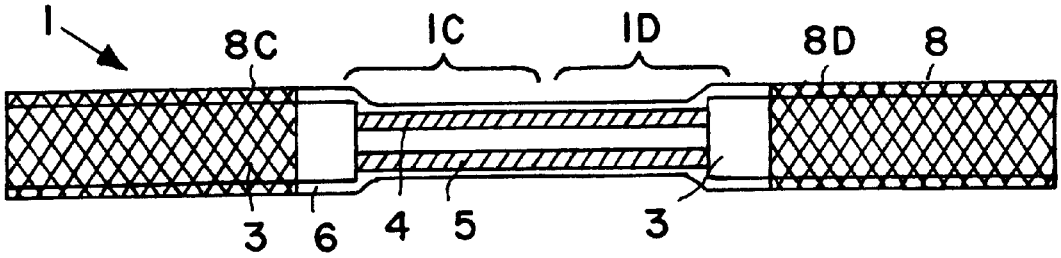
FIGS. 2A to 2C are schematic broken-away views illustrating the construction of a heater arrangement with a terminating element on an end thereof, whereby
Figure 2B:
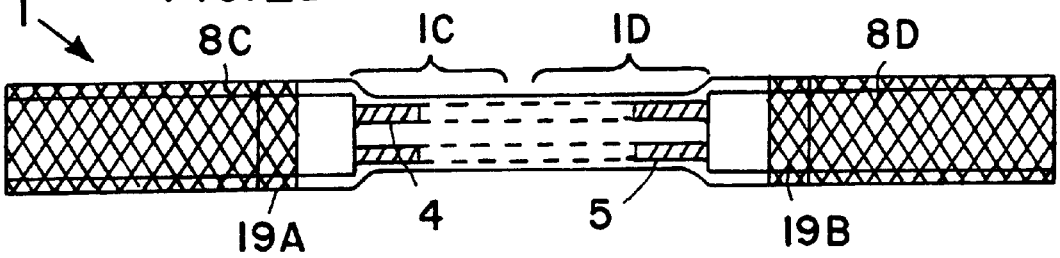
Figure 2C:
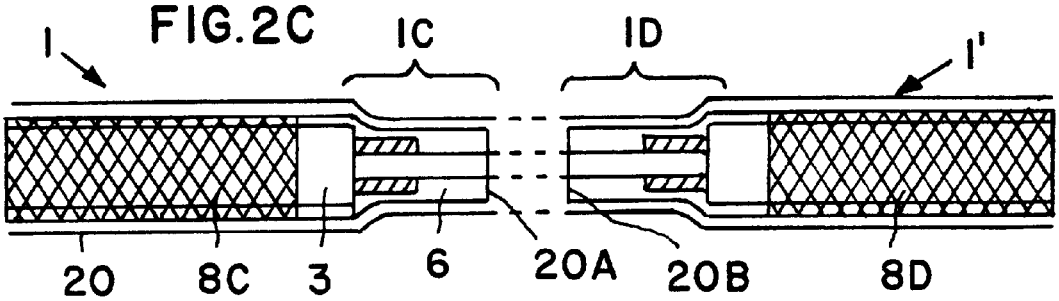

FIGS. 2A, 2B and 2C respectively illustrate successive steps in fabricating a heater arrangement 1 with terminating elements 1C or 1D on respective ends thereof. Generally, the same process steps that have been described above in FIGS. 1A, 1B and 1C for fabricating a connecting element 1A or 1B also apply for fabricating a terminating element 1C or 1D on a heater arrangement 1. Thus, in the first step the heating band conductors 4 and 5 of the heating band 3 of the heating element 2 of a heater arrangement 1 are exposed as shown in FIG. 1A. Then a layer 6 of a fluoropolymer plastic such as FEP is applied thereon by means of extrusion as shown in FIG. 1B, and a shielding braid 8 is pulled over the FEP layer 6 as shown in FIG. 1C.

Then, FIG. 2A illustrates the next successive process step that applies particularly for the fabrication of a terminating element 1C or 1D. Namely, the shielding braid 8 is similarly cut back, however, extending over the region of the exposed heating band conductors 4 and 5 so that also a portion of the heating band 3 itself is no longer covered by the shielding braid 8. The areas or regions 8C and 8D of the shielding braid 8 are visible, which represent the cut-back shielding braid 8 in the area of the terminating elements 1C and 1D.

FIG. 2B further shows that a narrow TEFLON (PTFE or FEP) band or tape 19A or 19B fixes the cut-back shielding braid regions 8C and 8D. A further connection of the shielding braid 8C or 8D to an extension line is not needed for the formation of a terminating element 1C or 1D at the end of the heater arrangement, so that the conductor ends of the shielding braid 8 can be fully enclosed by a sheath or jacket. The heating band connection conductors 4 and 5 are similarly shortened so that an end portion of the terminating elements 1C and 1D is entirely free of any conductors and thus does not include any current carrying components.

FIG. 2C shows that an outer protective jacket or sheath 20 has been applied over the shielding braid 8 and the areas of the terminating elements 1C and 1D by a subsequent extrusion process. After completion of this extrusion process, the heating element 2 is cut through and separated on a cutting plane in the area between the two terminating elements 1C and 1D to form two separate heater arrangements 1 and 1', each having its own respective separating terminating element portion 1C or 1D. The respective cut end faces 20A and 20B of the terminating element portions 1C and 1D are filled and enclosed with an FEP polymer material and then thermally welded in order to achieve a final seal. In this process, the introduction of heat causes the outer protective sheath or jacket 20 and the FEP layer 6 to become thermally welded or fused with each other in such a tight and intimate or integral manner that a completely tight seal is achieved and an additional adhesive bonding with an additional shrinkable tube is no longer necessary.

Figure 3A:
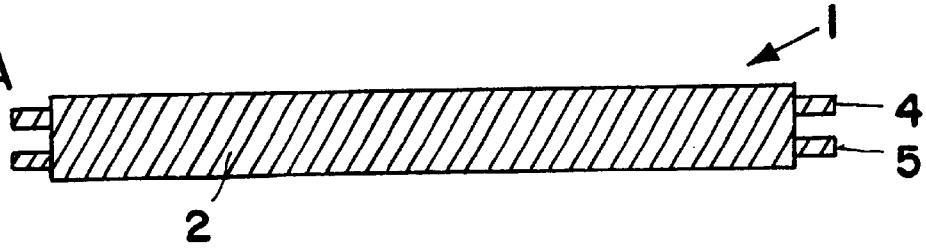
FIGS. 3A to 3I are schematic broken-away views illustrating a heater arrangement with a connecting element according to a second embodiment, whereby

FIGS. 3A to 3I illustrate a heater arrangement 1 with a second embodiment of a connecting element 1F arranged at one end thereof, whereby each successive Figure illustrates a respective successive step in the process for fabricating this different embodiment of a connecting element 1F. FIG. 3A shows the basic element of the heater arrangement 1, namely a heating element 2, as has been described above in detail in connection with FIG. 1A. However, in the present embodiment of the heater arrangement 1 with the varied connecting element 1F, it is not provided that two heater connections are fabricated simultaneously, as was the case with the two connection elements 1A and 1B of the above described embodiment. Instead, only a single connecting element 1F is individually fabricated on one end of the heating element 2.

Figure 3B:
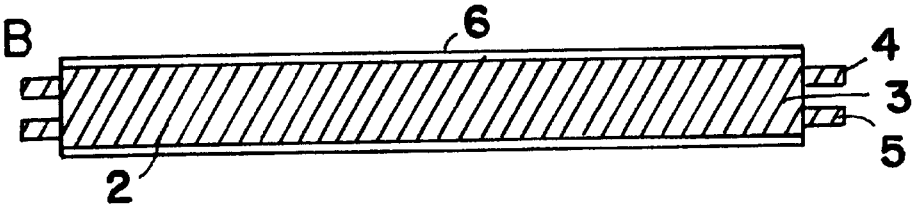

FIG. 3B shows that an extrusion process is carried out in order to apply a layer 6 of a fluoropolymer plastic such as fluorinated ethylene propylene (FEP) onto the heating element 2, which comprises a heating band matrix 3 as well as heating band conductors 4 and 5 as described above. Thus, this extrusion process forms an insulating and protective layer 6 of the synthetic plastic formable or moldable mass, in such a manner that the resulting layer 6 is water and pressure-tight and also resistant to hydraulic oils such as SKYDROL.

Figure 3C:
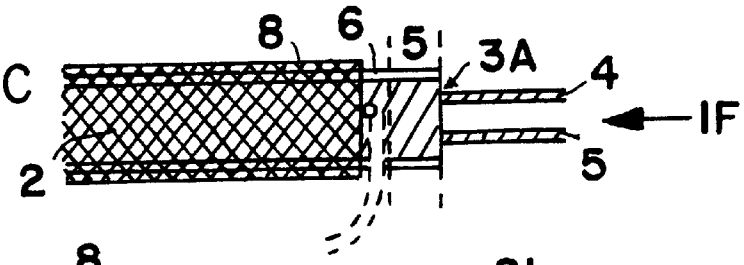

FIG. 3C shows a further process step, wherein the heating element 2 including the heating band matrix 3 and the conductors 4 and 5 therein is cut to the appropriate length and then the heating band conductors 4 and 5 are exposed in the connection area in order to be useable as connection conductors 4 and 5. This is achieved by cutting back the heating band matrix 3 to an appropriately located heating band matrix end face 3A. Then, a shielding braid 8 is arranged or pulled over the insulating layer 6, whereby this shielding braid 8 preferably is a spiral braid of copper/nickel strands. Next, the shielding braid 8 must be cut back in the area of the heater arrangement connection 1F. Then, in order to be able to carry out the following process step which will be described below and which is provided as an additional securing measure, at this time a corona discharge treatment of the heating band matrix end face 3A and the extruded insulating layer 6 is carried out in this area. This corona discharge treatment achieves a surface treatment and particularly a cleaning and roughening of the exposed layer surface by means of electron impingement of the surface, in order to ensure that a sufficient adhesion is achieved on this surface by an epoxy layer 21 or a butyl plastic potting mass in the next step.

Figure 3D:
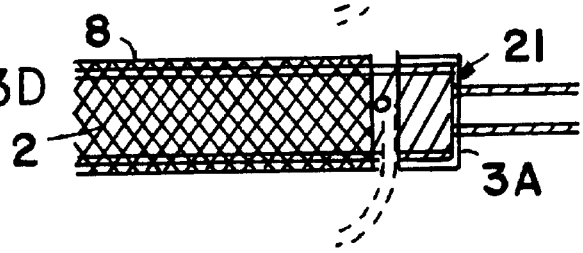

Namely, FIG. 3D shows this epoxy layer 21 having been applied onto and enclosing the area of the heating band matrix end face 3A. This epoxy layer 21 may, for example, be applied by dipping the respective end of the heater arrangement 1 into an epoxy solution or epoxy adhesive and then allowing the epoxy material to dry and cure. An alternative possibility to achieve a seal against moisture at this location is again to apply a butyl plastic potting mass onto the end of the heater arrangement and the splice area at this location. The epoxy layer 21 or the butyl plastic layer provides an additional means of ensuring that no moisture can penetrate into the end of the heater arrangement 1 so as to prevent such moisture penetration from causing arc tracking between the respective conductors 4 and 5, or other problems that would diminish or destroy the functionality of the heater arrangement 1.

Figure 3E:
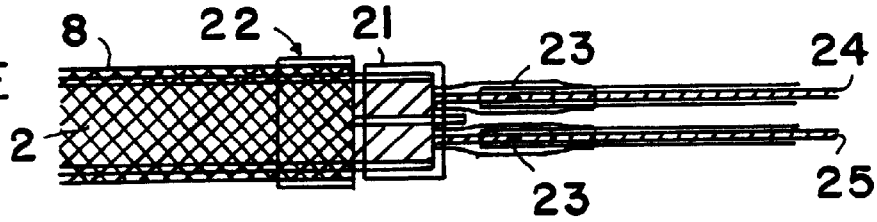

A next process step, which is shown in FIG. 3E, involves fixing the shielding braid 8 by means of a TEFLON (PTFE or FEP) band or tape 22. The ends of the heating band conductors 4 and 5 are connected to conductor lines 24 and 25 that are insulated with KAPTON polymer and preferably further jacketed or sheathed with FEP and preferably colored for identification, for example red and blue, respectively. These connections are, for example, achieved using through-going connectors 23. Next, shrinkable tubes are arranged over these spliced connections in order to provide insulation and protection. An adhesive and potting compound, which the prior art always required before such shrinkable tubes were pulled over a splice joint area, is no longer necessary in the inventive arrangement.

Figure 3F:
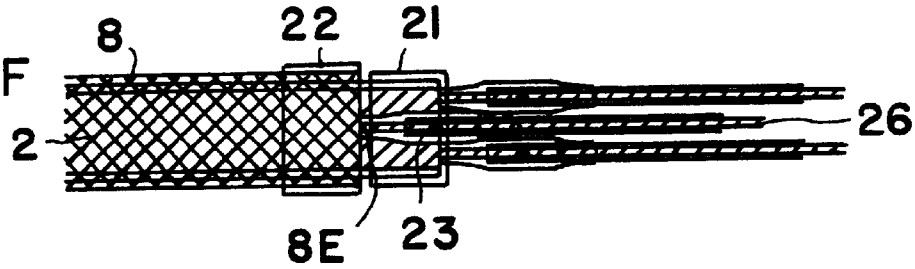

FIG. 3F shows a subsequent stage of the fabrication of the heater 1, in which an additional extension line 26 insulated with KAPTON and additionally sheathed in FEP has been connected to the protective braid 8. This can be achieved in a typical manner by combing out and twisting the strands of the braid and then connecting these twisted strands 8E to the extension line 26, for example using a through-going connector 23 and subsequently enclosing this spliced connection by pulling a shrinkable tube over it.

Figure 3G:
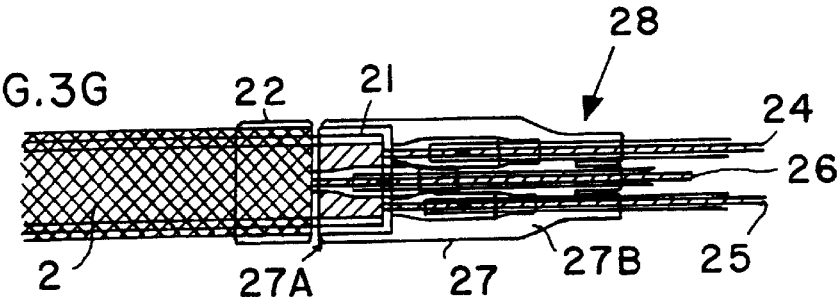

FIG. 3G shows a further successive process step in which an FEP molded part 27 has been pulled over the connection region of the heater arrangement 1, in order to properly center, locate and hold the three through-going connectors 23 mentioned above, together with the respective connected conductors 24, 25 and 26, in order to achieve a reproducible mass-produced connection. The molded part 27 is preferably embodied in the form of a hood or enclosure that can be pulled or pushed over the connection area of the connection conductors 4 and 5 as well as the shielding braid 8 together with the respective connected conductors 24, 25 and 26. The end 27A of the molded part 27 facing toward the heating band 3 has an appropriate inner diameter so that it can be pushed over the epoxy layer 21 and finally come to lie against the TEFLON band or tape 22. The outer diameter of the end 27A of the molded part 27 is matched to the outer diameter of the wrapping provided by the TEFLON band 22, in order to achieve a uniform or flush transition between the TEFLON band 22 and the molded part 27.

In this area, the molded part 27 is preferably cylindrical in shape, and then tapers to a smaller diameter at the opposite or free end 27B thereof. The inner diameter or inner contour of the molded part 27 similarly tapers to a smaller inner diameter at the other end 27B, and is so configured to receive, enclose, and cover the connections of the connecting conductors 4 and 5 and of the shielding braid 8 to the respective further conductors 24, 25 and 26, and so that the smaller or tapered end 27B of the molded part 27 guides and holds the conductors 24, 25 and 26 in a defined position at the end 27B where these conductors exit out of the molded part 27. For this purpose, the end 27B of the molded part 27 is filled with FEP material in such a manner so as to form respective receiving channels for the conductors 24, 25 and 26. In view of the FEP-jacketing of the conductors 24, 25 and 26, the end 27B of the molded part 27 that also consists of FEP material can be directly integrally thermally fused or welded to the sheathing or jacketing of the conductors 24, 25 or 26. The resulting thermally fused or melted region 28 is indicated in FIG. 3G, but the actual melting or thermal fusion process is actually only carried out in the next process step.

In an alternative embodiment, a butyl plastic filler mass or potting compound is used instead of the epoxy layer 21, as generally discussed above. In this case, the butyl plastic material is only filled into the hollow space between the molded part 27 and the various components enclosed therein after the FEP molded part 27 is pushed onto the various components as described above. Only thereafter the extrusion is carried out.

Figure 3H:
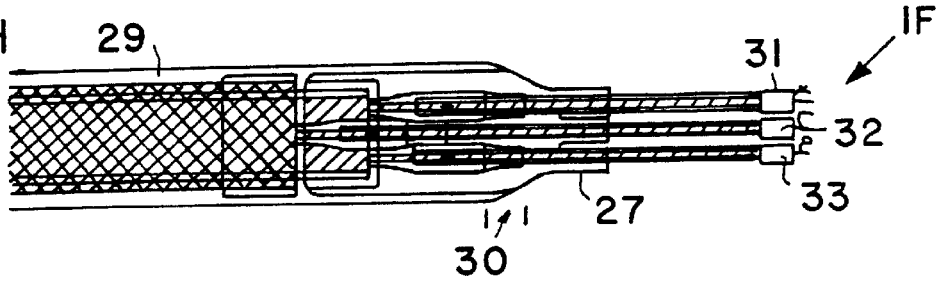

The formation of a second extruded layer 29 of FEP material on the heating band 3 and the cylindrical portion of the molded part 27 is shown in FIG. 3H. The respective FEP materials are thermally fused or melted to each other in the transition region 30 between the extruded layer 29 and the FEP molded part 27, and in the fused or melted area 28 between the end 27B of the molded part 27 and the sheathing or jacketing of the conductors 24, 25 and 26. Next, respective pin contacts 31, 32 and 33 are crimped onto the respective ends of the conductors 24, 25 and 26, whereby the water-tight and pressure-tight connection element 1F at the end of the heater arrangement 1 has been substantially completed.

Figure 3I:
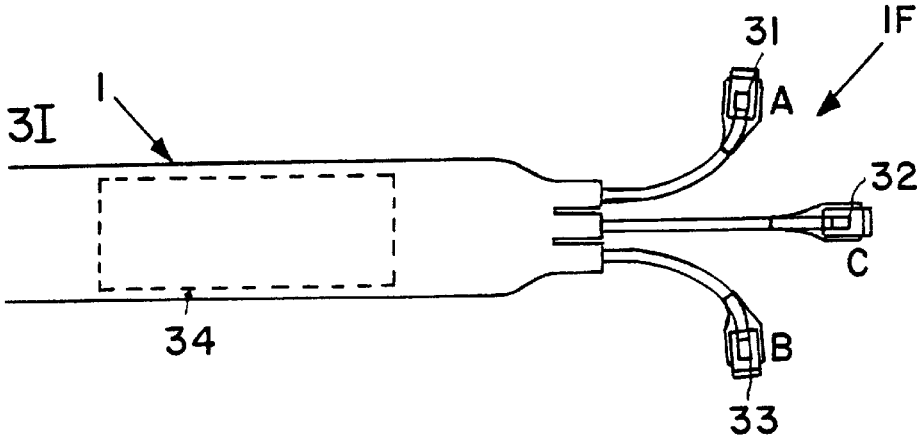

Finally, however, as shown in FIG. 3I, the heater arrangement 1 is to be labelled or otherwise provided with identifying indicia 34, which may be printed directly onto the heater arrangement 1. For example, these identifying indicia 34 may include a part number or other information regarding the particular properties and data of the finished heater arrangement 1. Respective shrinkable tubes are pulled over the pin contacts 31, 32 and 33, and these shrinkable tubes may in turn be labelled with identifying indicia such as part numbers or contact identifiers.

FIGS. 4A to 4D show a heater arrangement 1 with a second embodiment of a terminating element 1G arranged on an end thereof, whereby the successive FIGS. 4A, 4B, 4C and 4D respectively illustrate successive steps during the fabrication process thereof. Generally, the same initial process steps are carried out for fabricating the terminating element 1G on the heater arrangement 1 as were described above for fabricating the connection element 1F according to FIGS. 3A, 3B and 3C. Thus, in a first step, the heating band conductors 4 and 5 are exposed by removing the portion of the heating band matrix 3 at an end region of the heater arrangement 1 as shown in FIG. 3A. Then, a layer 6 of a fluoropolymer plastic such as FEP is applied by means of extrusion as shown in FIG. 3B. Also, a shielding braid 8 is pulled over the FEP layer 6 as shown in FIG. 3C. Further details of each of these three steps are described above in connection with those FIGS. 3A, 3B, and 3C.

Figure 4A:
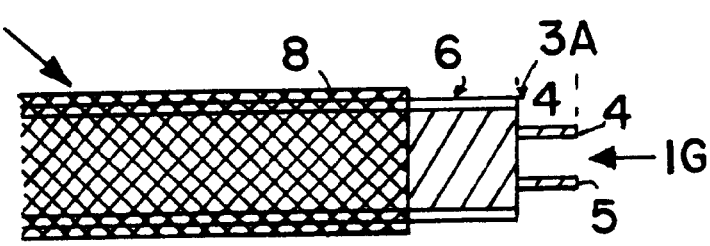
FIGS. 4A to 4D are schematic broken-away views illustrating a heater arrangement having a terminating element according to a second embodiment on an end thereof, whereby FIGS. 4A, 4B, 4C, and 4D respectively show successive steps in the process of fabricating the terminating element on the heater arrangement.

Next, in the fabrication of the terminating element 1G, FIG. 4A shows the end of the heater arrangement 1 that has been prepared in the above mentioned manner. Then a corona discharge treatment of the heating band matrix end face 3A and the extruded layer 6 is carried out in the end portion of the heater arrangement, in order to then carry out the subsequent process step that provides an additional measure of seal security. The corona discharge treatment achieves a surface treatment and particularly a surface cleaning and roughening of the respective surfaces by means of electron impingement thereof, in order to ensure an adequate adhesion of the subsequently applied epoxy layer 35 or layer of a butyl plastic mass.

Figure 4B:
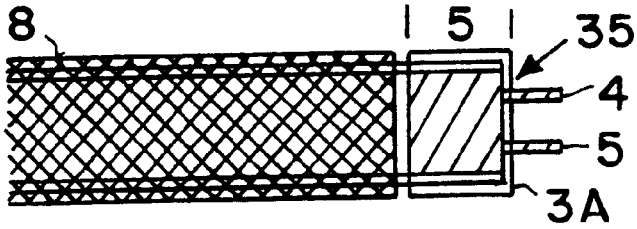
Figure 4C:
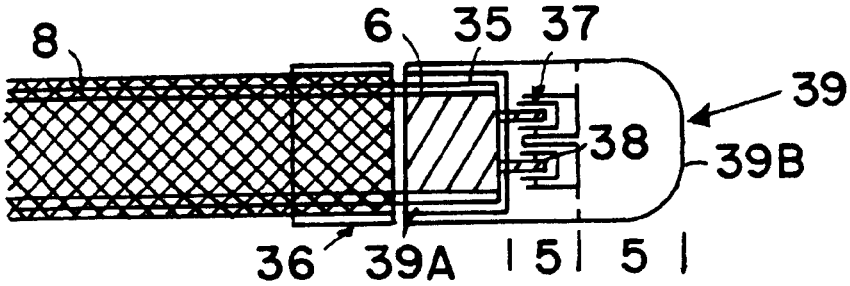

FIG. 4B shows such an epoxy layer 35 that has been applied over the end of the heating band matrix end face 3A. For example, this epoxy layer 35 may be applied by dipping the respective end of the heater arrangement 1 in an appropriate epoxy solution or epoxy adhesive, and subsequently allowing the epoxy to dry and cure. Instead of the epoxy layer 35 it is alternatively possible to apply a butyl plastic mass. The epoxy layer 35 or the butyl layer provides an additional measure of security to ensure that no moisture can penetrate into the end of the heater arrangement 1 and then cause arc tracking or the like which would impair the functionality of the heater arrangement 1.

Next, 4C shows a further subsequent step of fixing the shielding braid 8 using a TEFLON (PTFE or FEP) band or tape 36, whereby the shielding braid 8 is secured onto the first extruded layer 6. The respective heating band conductors 4 and 5 are respectively insulated by means of individual TEFLON (PTFE or FEP) tubes 37 and 38. An end cap 39 made of FEP material is pushed onto the end of the heater arrangement that has been prepared in the above described manner, whereby the open end 39A of the end cap 39 can preferably be pushed so far onto the end of the heater arrangement 1 so that it contacts and lies against the TEFLON tape wrapping 36. The closed end 39B of the end cap 39 is preferably rounded off. By using such an FEP molded part as an end cap 39, it is possible to achieve a reproducible mass produced termination in a simple manner. If a butyl plastic filler mass or potting compound is used to prevent penetration of moisture, this potting compound is then filled into the hollow spaces within the end cap 39.

Figure 4D:
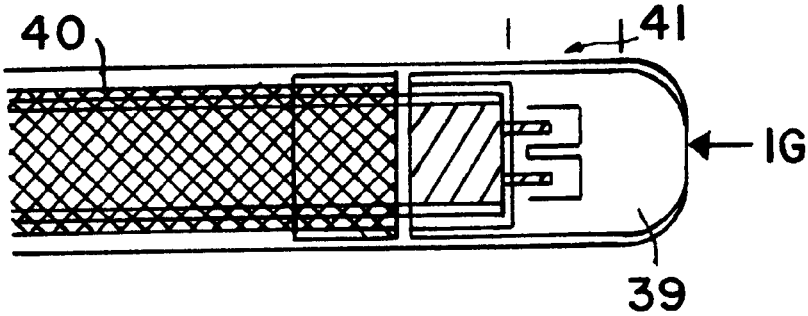

The last process step for fabricating the terminating element 1G on the end of the heater arrangement 1 is now described in connection with FIG. 4D. Namely, a second extruded layer 40 is formed over at least the entire end portion of the heater arrangement 1 including the end of the heater band, the TEFLON tape wrapping 36, and the FEP end cap 39. This extruded layer 40 of FEP material is thermally fused to the underlying FEP materials in a thermal fusion or melting region 41 that extends over at least the cylindrical part of the end cap 39 before the rounded off end 39B of the end cap 39.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A method of forming a connecting element on an end of a heater arrangement including a heating band with at least one heating conductor arranged therein, comprising the following seeps:

a) cutting open said heating band so as to expose said at least one heating conductor at a prescribed location;

b) applying a fluoropolymer layer onto said heating band by an extrusion process;

c) arranging a shielding conductor braid over said fluoropolymer layer;

d) cutting back said shielding conductor braid so as to remove said braid from an area of said connecting element and so as to form a junction lead on a cut portion of said braid;

e) connecting one end of an extension line to said junction lead;

f) applying an outer protective sheath of a fluoropolymer over at least a portion of said fluoropolymer layer, said shielding conductor braid, and said at least one heating conductor at said area of said connecting element, by a further extrusion process; and g) connecting at least one of respective conductor lines and respective contact members onto said at least one heating conductor, so as to form said connecting element.

2. The method according to claim 1, wherein said connecting in said step e) comprises at least one of welding, soldering, and splicing.

3. The method according to claim 1, wherein said forming of said junction lead in said step d) comprises combing out and twisting strands of said braid.

4. The method according to claim 1, further comprising securing said at least one heating conductor and said extension line with a polytetrafluoroethylene or fluorinated ethylene propylene (TEFLON) tape, before said step e).

5. The method according to claim 1, further comprising cutting through and separating said at least one heating conductor and said extension line along a cut plane so as to form a first heater arrangement with a first connecting element and a second heater arrangement with a second connecting element respectively on opposite sides of said cut plane, after said step f).

6. The method according to claim 1, further comprising thermally fusing or extruding said outer protective sheath so as to achieve a moisture-tight seal at a location at which said at least one heating conductor and said extension line exit and protrude out from said outer protective sheath.

7. The method according to claim 1, wherein said step g) comprises separating said at least one heating conductor and said extension line, and then connecting a respective one of said contact members onto each respective one of said at least one heating conductor and said extension line.

8. The method according to claim 7, wherein said contact members are respective pin contacts, and wherein said connecting of said contact members comprises crimping said pin contacts respectively onto said at least one heating conductor and said extension line.

9. The method according to claim 1, further comprising arranging different shrinkable tubes respectively on free ends of said at least one heating conductor and said extension line, so as to individually identify said at least one heating conductor and said extension line.

10. The method according to claim 1, further comprising connecting at least one insulated conductor respectively to said at least one heating conductor, and after said step e) arranging a hooded sleeve-shaped fluorinated ethylene propylene molded part over said at least one heating conductor, said at least one insulated conductor, and said extension line.

11. The method according to claim 10, wherein said molded part is so configured and said arranging of said molded part is carried out in such a manner that a first end of said molded part abuts against said shielding conductor braid and provides a water-tight seal at said first end, a central portion of said molded part receives, holds and guides therein said at least one heating conductor, said at least one insulated conductor and said extension line, and a second end of said molded part opposite said first end guides said at least one insulated conductor and said extension line in a defined manner so as to protrude outwardly therefrom.

12. The method according to claim 11, wherein said at least one insulated conductor and said extension line each respectively include a polytetrafluoroethylene or fluorinated ethylene propylene (TEFLON) coated sheath, and further comprising an additional step of thermally fusing said respective polytetrafluoroethylene or fluorinated ethylene propylene coated sheath of each said extension line and said at least one insulated conductor together with said second end of said molded part.

13. The method according to claim 10, further comprising applying a synthetic polymer layer onto a cut end surface of said heating band from which said at least one heating conductor protrudes, before said arranging of said molded part over said at least one heating conductor, said at least one insulated conductor and said extension line.

14. The method according to claim 10, further comprising filling at least one hollow space within said molded part with a butyl polymer potting compound.

15. The method according to claim 10, further comprising treating at least one surface area of said heating band with a corona discharge treatment.

16. A method of forming a terminating element on an end of a heater arrangement including a heating band with at least one heating conductor arranged therein, comprising the following steps:

a) cutting open said heating band so as to expose said at least one heating conductor at a prescribed location;

b) applying a fluoropolymer layer onto said heating band by an extrusion process;

c) arranging a shielding conductor braid over said fluoropolymer layer;

d) cutting back said shielding conductor braid so as to remove said braid from an area of said terminating element;

e) exposing conductor strands of said at least one heating conductor at a respective end thereof in said area of said terminating element;

f) applying an outer protective sheath of a fluoropolymer over at least a portion of said fluoropolymer layer, said shielding conductor braid, and said area of said terminating element, by a further extrusion process; and g) thermally fusing or extruding at least one of said outer protective sheath of a fluoropolymer and said fluoropolymer layer at an end of said heater arrangement at said area of said terminating element to form a tight seal at said end.

17. The method according to claim 16, further comprising cutting through and separating said at least one heating conductor, said fluoropolymer layer and said outer protective sheath along a cut plane in said area of said terminating element, so as to form a first heater arrangement with a first terminating element and a second heater arrangement with a second terminating element respectively on opposite sides of said cut plane, after said step f).

18. The method according to claim 17, further comprising filling void spaces in cut ends of said first and second heater arrangements formed along said cut plane with a fluoropolymer plastic, before said step g).

19. The method according to claim 16, further comprising arranging an end cap that is molded of a fluoropolymer onto an end of said heater arrangement at said area of said terminating element, after said step e).

20. The method according to claim 19, further comprising applying an epoxy layer onto said end of said heater arrangement at said area of said terminating element, before said arranging of said end cap onto said end.

21. The method according to claim 19, further comprising filling at least one hollow space within said end cap with a butyl polymer potting compound for sealing said end cap.

22. The method according to claim 19, further comprising treating at least one surface area of said heating band with a corona discharge treatment.

23. The method according to claim 16, further comprising securing a cut-back edge of said shielding conductor braid with a polytetrafluoroethylene or fluorinated ethylene propylene (TEFLON) tape, after said step d).

24. The method according to claim 16, wherein said step g) is carried out under vacuum.

25. A heater arrangement comprising:

a heating band;

heating conductors extending in and protruding from an end of said heating band;

a fluoropolymer protective layer covering at least a portion of said heating band and said heating conductors;

at least one element selected from the group consisting of a connecting element and a terminating element provided at said end of said heating band; and an additional fluoropolymer material covering at least a junction area and providing a seal between said end of said heating band and said element, wherein said additional fluoropolymer material comprises a plastic molded part arranged over said conductors at an area of said element and forming a part of said element.

26. The heater arrangement according to claim 25, wherein said plastic molded part consists essentially of fluorinated ethylene propylene.

27. The heater arrangement according to claim 25, wherein said element is said connecting element, and said plastic molded part is a molded pass-through junction part.

28. The heater arrangement according to claim 27, further comprising respective additional conductors connected to and extending from ends of said heating conductors at respective splice joints, wherein said molded pass-through junction part has a shape of a sleeve hood including a first end extending onto and receiving therein said end of said heating band, a middle section with at least one hollow passage therein receiving and covering said splice joints, and a second end with at least one conductor outlet through which said additional conductors protrude outwardly from said molded pass-through junction part.

29. The heater arrangement according to claim 25, wherein said element is said terminating element, and said plastic molded part is a molded end cap.

30. The heater arrangement according to claim 29, wherein said molded end cap includes an open end that extends onto and receives therein said end of said heating band, and a closed end that covers and insulates respective ends of said conductors.

31. The heater arrangement according to claim 25, wherein said additional fluoropolymer material further comprises an extruded fluoropolymer layer that is extruded over said heating band and said plastic molded part, and wherein said extruded fluoropolymer layer is thermally fused onto and with said plastic molded part at least in a transition region where an edge of said extruded fluoropolymer layer overlaps onto said plastic molded part.

32. The heater arrangement according to claim 25, further comprising a shielding conductor braid arranged on said protective layer at a location displaced away from said element so that said shielding conductor braid is not provided at a location of said element.

33. The heater arrangement according to claim 25, wherein said fluoropolymer protective layer consists essentially of fluorinated ethylene propylene.

34. The heater arrangement according to claim 25, wherein said additional fluoropolymer material forms a pressure-tight and moisture-tight seal with said fluoropolymer protective layer.

35. The heater arrangement according to claim 25, further comprising a plastic layer that is arranged on an end face of said heating band at said end of said heating band from which said conductors protrude.

36. The heater arrangement according to claim 35, wherein said plastic layer achieves a pressure-tight and moisture-tight sealed connection.

37. The heater arrangement according to claim 35, wherein said plastic layer consists essentially of at least one of an epoxy and a butyl polymer material.

38. A heater arrangement comprising:

a heating band;

heating conductors extending in and protruding from an end of said heating band;

a fluoropolymer protective layer covering at least a portion of said heating band and said heating conductors;

at least one element selected from the group consisting of a connecting element and a terminating element provided at said end of said heating band; and an additional fluoropolymer material covering at least a junction area and providing a seal between said end of said heating band and said element, wherein said additional fluoropolymer material is at least one of thermally welded and extruded so as to form a pressure-tight and moisture-tight connection.

39. The heater arrangement according to claim 38, further comprising a shielding conductor braid arranged on said protective layer at a location displaced away from said element so that said shielding conductor braid is not provided at a location of said element.

40. The heater arrangement according to claim 39, wherein said additional fluoropolymer material comprises a fluoropolymer protective sheath covering said fluoropolymer protective layer and said shielding conductor braid.

41. The heater arrangement according to claim 38, excluding from said element all synthetic polymer materials other than fluorinated ethylene propylene.

42. The heater arrangement according to claim 38, excluding from said element all shrinkable tubes, adhesives and potting compounds.

* * * * *

UNITED STATES PATENT AND TRADEMARK OFFICE

CERTIFICATE OF CORRECTION

PATENT NO. : 6,423,952 B1
DATED : July 23, 2002
INVENTOR(S) : Meisiek

It is certified that error appears in the above-identified patent and that said Letters Patent is hereby corrected as shown below:

Column 5,
Line 14, after "the", insert -- disadvantages --;

Column 6,
Line 66, after "TEFLON", replace "(polytetraf luoroethylene" by
-- polytetrafluoroethylene --.

Signed and Sealed this

Twenty-sixth Day of November, 2002

*Attest:*

*Attesting Officer*

JAMES E. ROGAN
*Director of the United States Patent and Trademark Office*